United States Patent [19]

Rohr

[11] Patent Number: 4,968,418

[45] Date of Patent: Nov. 6, 1990

[54] APPARATUS FOR WASHING OUT AND SORTING ORGANIC, LOAMY AND OTHER IMPURITIES FROM CONTINUOUSLY SUPPLIED COARSE AND FINE GRANULAR SOLIDS

[76] Inventor: Wolfgang Rohr, Zeppelinstrasse 16, 6720 Speyer/Rh., Fed. Rep. of Germany

[21] Appl. No.: 431,215

[22] Filed: Nov. 3, 1989

[30] Foreign Application Priority Data

Nov. 24, 1988 [DE] Fed. Rep. of Germany ..... 3839666

[51] Int. Cl.[5] ..... B03B 5/28

[52] U.S. Cl. ..... 209/430; 209/173

[58] Field of Search ..... 134/73, 74, 126, 130, 134/131, 134; 68/3 SS, 44, 45, 62, 158; 209/308, 428–433, 173; 198/631

[56] References Cited

U.S. PATENT DOCUMENTS

| | | | |
|---|---|---|---|
| 269,563 | 12/1882 | Davis | 209/433 X |
| 4,052,299 | 10/1977 | Rohr | 209/430 |
| 4,696,736 | 9/1987 | Bleh | 209/430 X |

*Primary Examiner*—Philip R. Coe

*Attorney, Agent, or Firm*—Kinzer, Plyer, Dorn, McEachran & Jambor

[57] ABSTRACT

The apparatus serves for washing out and sorting organic, loamy and other impurities from continuously supplied coarse and fine granular solids, such as freshly dredged and treated gravel, with a chute 12 supplying the material to a washing trough 30 and spray jets 8, 10 for the washing liquid, consisting of an endless conveyor belt 29 supported on support rollers which are mounted on the machine frame 1 in such a manner that one section 9 of the conveyor belt is arranged downstream of the chute 12 and is formed as a washing trough 30, while the other section 11 of the conveyor belt 29 is arranged underneath the chute 12 and rising upwards against the direction of flow of the material supplied, the conveyor belt 29 being driven in the opposite direction to the direction of flow of the material supplied through the chute. Support rollers 6 and 17 are arranged to the side of the outer deflection pulley 32, in the direction of movement 4 of the conveyor belt 29. The roller 6 is formed as a tapping roller and comprises one or more tapping ribs 3 arranged transversely to the direction of movement 4 of the conveyor belt 29 and constituting humps on the surface of the deflection roller.

4 Claims, 2 Drawing Sheets

APPARATUS FOR WASHING OUT AND SORTING ORGANIC, LOAMY AND OTHER IMPURITIES FROM CONTINUOUSLY SUPPLIED COARSE AND FINE GRANULAR SOLIDS

The present invention relates to an apparatus for washing out and sorting organic, loamy and other impurities from continuously supplied coarse and fine granular solids, such as freshly dredged and treated gravel, with a chute supplying the material to a washing trough and spray jets for the washing liquid, consisting of an endless conveyor belt supported on support rollers and guiding pulleys which are mounted on the machine frame in such a manner that one section of the conveyor belt is arranged downstream of the chute with a subsequent settling section and is formed as a washing trough, while the other section of the conveyor belt is arranged underneath the chute and rises against the direction of flow of the supplied material, the conveyor belt being driven in the opposite direction to the direction of flow of the material supplied through the chute.

An apparatus having these features is known (German patent No. 2,542,940). This apparatus serves to separate foreign material from continuously supplied granular solids such as, for example, freshly dredged gravel, and this by means of a washing liquid, especially water, in which these foreign materials collect and are discharged floating in the water. These foreign materials are in particular pieces of wood, humus, loam, coal, waste rock or other organic and specifically lighter components. The section of the conveyor belt downstream of the washing trough serves essentially as a settling section, whose function is to ensure that a large proportion of gravel and sand are retained so that these are not discharged with the impurities. The apparatus is essentially adapted to the material supplied by modifying the washing trough and the subsequent separating section. It has been found that substances which had already been separated in the separating section are recombined, in other words, separation is not satisfactory in the area of the washing trough, while the efficiency of the apparatus is not optimal. Consequently, it is often necessary to subject the finished product to one or more further treatments in order to further reduce the proportion of pollutants.

The object of the invention is to improve the discharge of pollutants and thus the efficiency of an apparatus of the aforementioned kind.

According to the invention, this object is achieved in that at least one tapping roller is provided in the area of the washing trough of the conveyor belt which comprises one or more webs arranged transversely to the direction of movement of the conveyor belt and constituting humps on the surface of the tapping roller.

An advantageous embodiment consists in that the tapping roller is arranged at the transition point between the washing trough and the settling section.

According to another advantageous embodiment, spray jets oriented against the direction of movement of the conveyor belt are provided above the belt in the area of the washing trough.

It is also an advantage that the supporting or tapping rollers are horizontally and vertically adjustable.

It is advantageous for the webs to have for instance a circular, semi-circular or multi-edged cross-section and to be made, for example, of metal, rubber or synthetic material.

It has been found that the discharge of impurities is substantially improved by forming the supporting roller of the washing trough as a tapping roller. The tapping roller causes the material to vibrate in the area of the separating section. This effect is enhanced by the spray jets disposed in the area of the vibrating section above the washing trough, which convey the light components of the impurities bouncing upwards as a result of the separation-promoting vibration towards the discharge point.

The invention will be explained in further detail in the following description given with reference to exemplified embodiments illustrated in the drawings.

Figure 1:
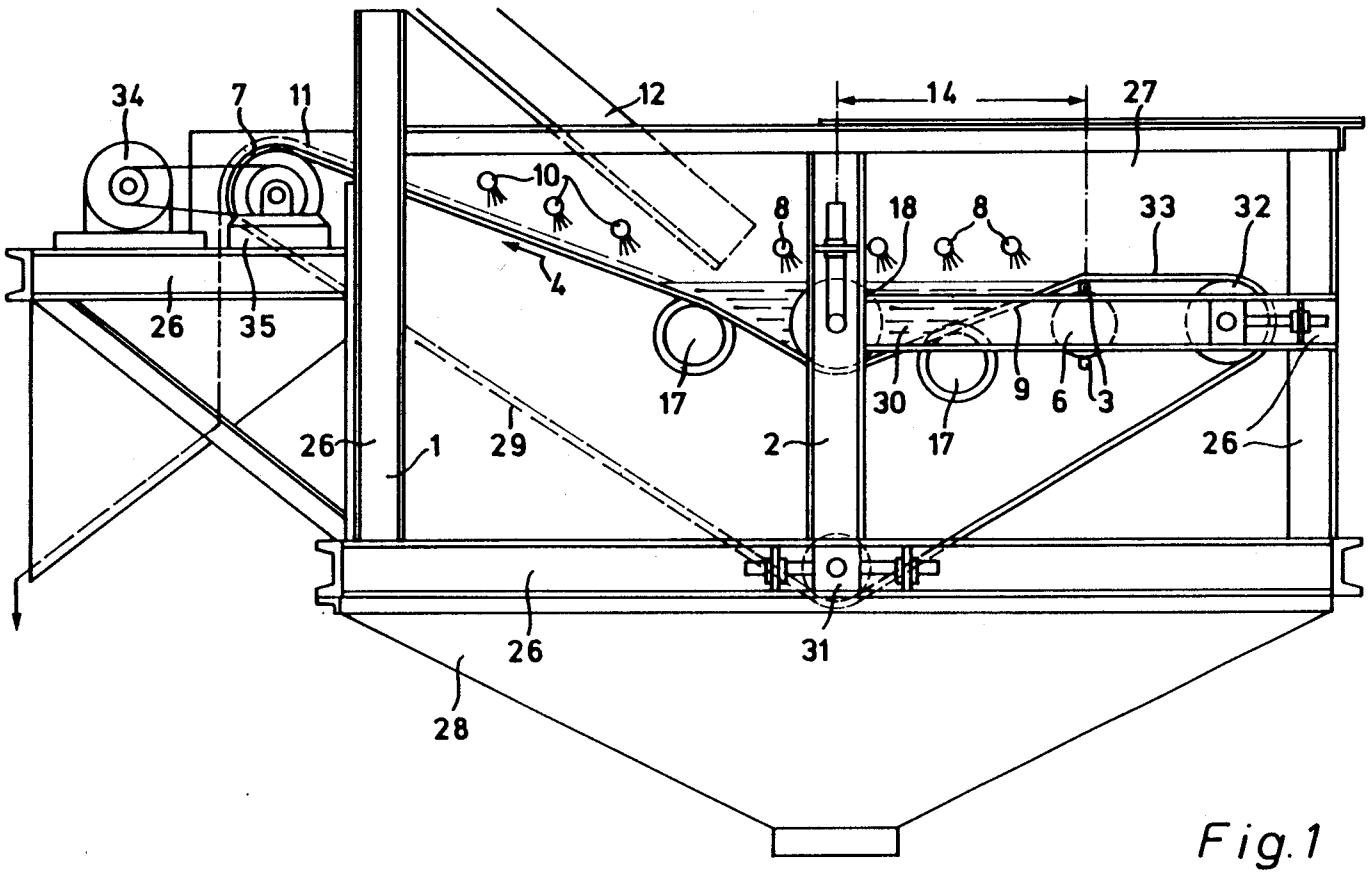
FIG. 1 shows a front view of an embodiment of the invention.
Figure 2:
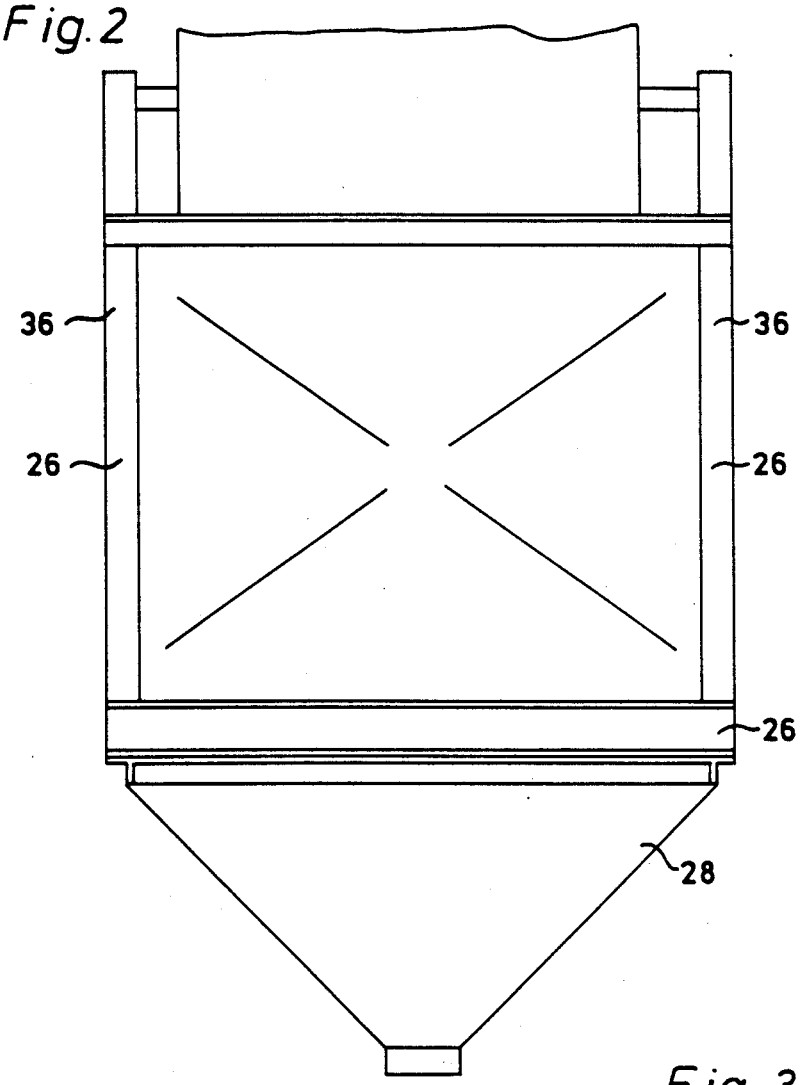
FIG. 2 is a lateral view of FIG. 1.

The apparatus represented in FIGS. 1 and 2 comprises a machine frame 1 composed of distinct carriers 2, 26 provided with an inner lining to form a vessel 27 with a discharge hopper 28. Pressure or support rollers are mounted on the individual carriers 2, 26 with a conveyor belt 29 being guided around them. The upper section of the conveyor belt 29 serves for the actual washing process, the actual washing trough 30 being formed by a section 9 of the conveyor belt 29 which is disposed downstream of a chute 12 while another section 11 of the conveyor belt 29 is arranged underneath the chute 12 to rise against the direction of flow of the material supplied through the chute. The shape of the washing trough 30 is determined by the pressure roller 18 which is adjustable in height and arranged on the carrier centrally between the outer deflection pulleys 7, 32 and the adjustable rollers 6, 17. In the area of its section 9, the conveyor belt 29 is guided over a further outer deflection pulley 32 which at the same time serves as a guiding pulley, while a horizontal or slightly inclined section 33 (setting section) of the conveyor belt 29 is disposed between the rollers 6 and 32. The opposite section 11 of the conveyor belt 29 is guided at the uppermost point over a drive pulley 7 with a drive motor 34, the pulley 7 being adjustable in height by means of shims 35. Below the pressure roller 18, the conveyor belt is guided over a deflection pulley 31. The pulley 31 is mounted to be vertically adjustable on the carrier 2, whilst the rollers 6 and 17 can be adjusted vertically as well as horizontally.

The support roller 6 is formed as a tapping roller, i.e. it has on its circumference at least on hump (3) or radially projecting protuberance arranged transversely to and engaging the underside of the conveyor belt 29. Circular steel bars, for example, can be provided as humps or tapping ribs, the number of ribs being dependent on the material to be treated, the speed of the belt and the diameter of the deflection roller 6. Essentially, the section between the central pressure roller 18 and the tapping roller 6 is to be considered as the vibrating section 14. If required, additional tapping rollers can be arranged in this area. In particular, individual spray jets 8 are disposed in this area above the washing trough, which are oriented against the direction of movement 4 of the conveyor belt 29. Auxiliary spray jets 10, likewise oriented against the direction of movement 4 of the conveyor belt 29, are arranged in the area of the rising section 11 of the conveyor belt 29.

In an apparatus of this kind in which the washing trough 30 is formed without using the pressure roller 18, the tapping roller(s) 6 may be arranged in the entire area of the washing trough 30.

Figure 3:
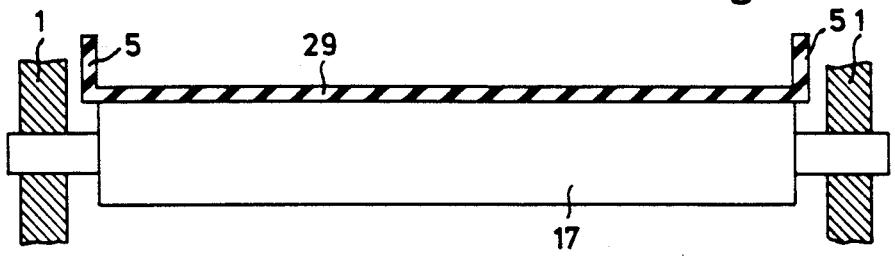
FIG. 3 is a cross-sectional view of the apparatus using a belt with corrugated edges.

In the embodiment of FIGS. 1 and 2, the conveyor belt 29 is arranged between side walls 36 of the vessel 27 collecting the material, whereas in the further embodiment according to FIG. 3 the conveyor belt 29 is formed as a belt with corrugated edges having upright side sections 5.

I claim:

1. An aparatus supported by a machine frame for washing out and sorting organic, loamy and other impurities from continuously supplied coarse and fine granular solids, such as freshly dredged and treated gravel, with a chute supplying the material to a washing trough and spray jets for supplying the washing liquid, consisting of an endless conveyor belt (29) supported on supporting rollers and guiding pulleys which are mounted on the machine frame in such a manner that one section of the conveyor belt forms a washing trough (30) arranged beneath and downstream of the chute with a subsequent settling section (33) elevated above the washing trough, the conveyor belt in said one section being driven in the opposite direction to the direction of flow of the material supplied through the chute, characterized in that at least one tapping roller (6) is positioned beneath the conveyor belt in the area of the washing trough (30), said tapping roller having on its periphery one or more webs (3) providing a radially projecting protuberance arranged transversely to the direction of movement (4) of the conveyor belt (29) and constituting humps on the surface of the tapping roller (6) engageable with the conveyor belt to vibrate material thereon and bounce upwards light components of the material to be separated from the material and further characterized in that the tapping roller (6) is disposed at the transition point between the washing trough (30) and the settling section (33).

2. An apparatus according to claim 1 characterized in that spray jets (8) which are oriented toward the settling section and against the direction of movement (4) of the conveyor belt (29) are provided above the conveyor belt (29) in the area of the washing trough (30).

3. An apparatus according to claim 2 characterized in that the support and tapping rollers (17, 6) are horizontally and vertically adjustable.

4. An apparatus according to claim 1 characterized in that the support and tapping rollers (17, 6) are horizontally and vertically adjustable.

* * * * *